US012083647B1

(12) United States Patent
Lu et al.

(10) Patent No.: US 12,083,647 B1
(45) Date of Patent: Sep. 10, 2024

(54) MAGNETORHEOLOGICAL-ELASTOMER POLISHING PAD FOR CHEMICAL MECHANICAL POLISHING OF SEMICONDUCTOR WAFER, PREPARATION METHOD AND APPLICATION THEREOF

(71) Applicant: Guangdong University of Technology, Guangdong (CN)

(72) Inventors: Jiabin Lu, Guangdong (CN); Da Hu, Guangdong (CN); Haotian Long, Guangdong (CN); Yuhang Jin, Guangdong (CN); Qiang Xiong, Guangdong (CN)

(73) Assignee: Guangdong University of Technology, Guangzhou (CN)

( * ) Notice: Subject to any disclaimer, the term of this patent is extended or adjusted under 35 U.S.C. 154(b) by 0 days.

(21) Appl. No.: 18/626,295

(22) Filed: Apr. 3, 2024

(30) Foreign Application Priority Data

Jul. 31, 2023 (CN) ..... 202310946782.7

(51) Int. Cl.
*B24B 37/24* (2012.01)

(52) U.S. Cl.
CPC ..... *B24B 37/24* (2013.01)

(58) Field of Classification Search
None
See application file for complete search history.

(56) References Cited

U.S. PATENT DOCUMENTS 7,371,160 B1 * 5/2008 Cruz ..... B24B 37/24 451/526
2011/0034578 A1 * 2/2011 Zhang ..... C08G 18/7621 521/160
2018/0311792 A1 * 11/2018 Qian ..... B24D 18/0009

FOREIGN PATENT DOCUMENTS

| | | | |
|---|---|---|---|
| CN | 1224501 C | | 10/2005 |
| CN | 1269615 C | | 8/2006 |
| CN | 101428404 A | | 5/2009 |
| CN | 101870851 B | | 1/2013 |
| CN | 113770816 A | * | 12/2021 |
| CN | 115157111 A | | 10/2022 |

(Continued)

OTHER PUBLICATIONS

'Preparation and Polishing Characteristics of Magnetorheological Elastic Polishing Pad for Single-Crystal SiC' Hu Da, China Excellent Master's Dissertation Full text Database Engineering Science and Technology I series; Issue 01, 2023, pp. 8-9, 14, 23-29, 32, 78, Jan. 15, 2023.

*Primary Examiner* — Binh X Tran

(57) ABSTRACT

Disclosed is a magnetorheological-elastomer (MRE) polishing pad suitable for chemical mechanical polishing (CMP) of a semiconductor wafer, which simultaneously realizes high-efficiency magnetic control polishing and high-efficiency Fenton reaction, forms an organosilicon-polyurethane matrix through an organosilicon-modified polyurethane prepolymer, and combines the characteristics of high flexibility and excellent comprehensive mechanical properties of organosilicon. CIP@$Fe_3O_4$ composite magnetic par- (Continued)

ticles in the polishing pad can make the MRE polishing pad exhibit a high magnetorheological effect, and the produced ·OH can oxidize a surface of the semiconductor wafer to generate an oxide layer, reducing the material removal difficulty of abrasive materials and the polishing pad under the mechanical action.

4 Claims, 2 Drawing Sheets

(56) References Cited

FOREIGN PATENT DOCUMENTS

| | | | | |
|---|---|---|---|---|
| EP | 2151299 A2 * | 2/2010 | ..... | B24B 37/24 |
| JP | 3325016 B2 | 9/2002 | | |

* cited by examiner

MAGNETORHEOLOGICAL-ELASTOMER POLISHING PAD FOR CHEMICAL MECHANICAL POLISHING OF SEMICONDUCTOR WAFER, PREPARATION METHOD AND APPLICATION THEREOF

CROSS-REFERENCE TO RELATED APPLICATIONS

This application claims priority of Chinese Patent Application No. 202310946782.7, filed on Jul. 31, 2023, the entire contents of which are incorporated herein by reference.

TECHNICAL FIELD

The present disclosure relates to the field of polymer materials and the technical field of ultra-precision polishing, and in particular to a magnetorheological-elastomer (MRE) polishing pad for chemical mechanical polishing (CMP) of a semiconductor wafer, a preparation method and an application thereof.

BACKGROUND

In order to obtain high-efficiency and high-quality processed surfaces for semiconductor wafers, various ultra-precision polishing processing methods have been proposed. CMP is considered to be one of the most effective processing techniques to obtain the planarization of hard and brittle photoelectric materials, which is the key to ensure the ultra-smooth, defect-free and damage-free surfaces of processed wafers. CMP is to oxidize a surface of the wafer by utilizing chemical reaction to form a surface softening layer with low hardness, weak strength and low binding force, and then remove a mechanical material through the relative movement among a polishing pad, an abrasive material and the wafer. In CMP, to realize high-efficiency material removal and obtain non-damaged ultra-smooth surfaces, the core is to realize the balance between chemical action and mechanical action. At present, CMP mainly changes the polishing pad, abrasive particles, polishing pressures and adjusts an intensity of chemical action to realize the balance of different polishing stages.

In CMP, the polishing pad is one of the most important components. The performance (hardness, elastic modulus, compressibility, porosity, etc.) of the polishing pad is one of the key factors affecting the polishing efficiency and quality of the wafer. In general, the polishing pads can be classified into a hard polishing pad and a soft polishing pad according to the hardness degree in its physical properties. In a rough polishing stage, the hard polishing pad can achieve the planarization quickly with high polishing efficiency. In a final finishing polish stage, the soft polishing pad can reduce or even eliminate surface/subsurface damage of the wafer to obtain an ultra-smooth atomic surface.

An MRE is a magnetic-control smart material formed by the distribution of magnetic particles in a polymer. As a processing tool, MRE has the characteristic of controllable hardness, and its hardness variation can be controlled according to an intensity of an applied magnetic field. In the rough polishing and final finishing polish stages, according to the hardness requirements of polishing pads, the intensity of the applied magnetic field can be changed to control the hardness variation, thus controlling the processing efficiency and surface quality.

The research on MRE focuses on two aspects: matrix materials and magnetic particles.

At present, organosilicon matrixes and polyurethane matrixes are commonly used in MRE matrix materials. At present, most of the applications of MREs are focused on vibration control, mechanical engineering, civil engineering and other fields. It is required that MRE has the characteristic of a high magnetorheological effect, while the use of silicon rubber matrixes has the best magnetorheological effect. MRE is rarely applied in the field of grinding and polishing. If it is applied in the field of grinding and polishing, MRE needs to have the high magnetorheological effect and good mechanical properties. However, no researchers have combined the silicone rubber matrixes and the polyurethane matrixes for MRE research.

Silicone rubber in the organosilicon matrix has very good flexibility, hydrolysis resistance and acid-alkali resistance, and is widely used in MRE due to an excellent magnetorheological effect. However, the mechanical properties of silicone rubber matrix are very poor and difficult to apply in polishing. For example, a method for composite polishing by utilizing an MER was disclosed in the patent CN111906683A. A matrix of a polishing grinding wheel was silicone rubber, having poor mechanical properties, poor wear resistance, and no micropore chips on a surface, even no chemical action involving Fenton reaction to improve the processing efficiency. The processing process is pure mechanical material removal, having low processing efficiency. There is subsurface damage in a certain depth on the processed surface, which is not suitable for ultra-precision processing of hard and brittle semiconductor wafers.

However, a polyurethane-based MRE matrix has excellent mechanical and physical properties, but the magnetorheological effect would be limited, and a polyurethane-based polishing pad would be easily glazed after being polished with an acid-alkali polishing solution, which further reduces the material removal capacity. Although the prior art has studied how to overcome the problem that the polyurethane-based polishing pad would be easily glazed after being polished with an acid-alkali polishing solution, for example, a polyester polyurethane organosilicon prepolymer and a preparation method thereof were disclosed in the patent CN109400840A, and the obtained polymer had better medium resistance, and acid-alkali resistance, the Si—O—C generated when hydroxyl-terminated silicone oil is modified is easily hydrolyzed and unstable, that is, a new problem appears after solving the problem of easy to glaze. An MRE, a preparation method and an application thereof were disclosed in the patent CN113770816A, the mechanical removal of polishing is realized by utilizing a magnetic field to control the hardness of a polishing pad, and the heterogeneous Fenton reaction occurs on magnetic particles in the MRE to obtain high-efficiency material removal. However, the high strength of a polyurethane-based MRE leads to little magnetorheological effect, that is, a hardness variation of polishing pad under the control of magnetic field is very small, and it is difficult to realize good magnetic control mechanical removal. In addition, the polyurethane-based polishing pad have poor hydrolytic stability and acid-alkali resistance, and the glazing of polishing pad can further reduce material removal capacity. At present, the research on magnetic particles of MRE also has major problems, for example, magnetic particles in the MRE polishing pad in the patent CN113770816A are carbonyl iron powder (CIP) and/or $Fe_3O_4$; when the magnetic particle applied is CIP, CIP has high saturation magnetization intensity and low coercivity, which is commonly applied in magnetorheological fluids and magnetic particles in MRE to produce better magnetorheological effect, but the catalytic effect of Fenton reaction with CIP as a solid phase catalyst is weak; when the magnetic particle applied is $Fe_3O_4$, the polishing pad cannot obtain a high magnetorheological effect; and when the magnetic particle applied is CIP and $Fe_3O_4$, it is not possible to realize both high magnetorheological effect and high-efficiency Fenton reaction on the MRE polishing pad. Therefore, the MRE polishing pad cannot combine high-efficiency magnetic control polishing with high-efficiency Fenton reaction polishing.

A Fenton reaction grinding disk for a SiC wafer was disclosed in the patent CN113601390A, in which a magnetic particle catalyst is one or more of ferrosoferric oxide, CIP or reduced iron powder, the catalyst having a particle size of 1-300 μm, while a catalyst with a micron particle size tends to have a small specific surface area and weak Fenton reaction.

That is to say, there is no research on the applicability of the MRE polishing pad for CMP of the semiconductor wafer at present, and even more there is no disclosure of the research on a suitable matrix material of MRE and magnetic particles, to ensure that the MRE polishing pad is applicable for the CMP of the semiconductor wafer and can simultaneously realize high-efficiency magnetic control polishing and high-efficiency Fenton reaction.

SUMMARY

Based on the above technical problems, an object of the present disclosure is to provide an MRE polishing pad suitable for CMP of a semiconductor wafer. Further, the provided MRE polishing pad suitable for CMP of a semiconductor wafer is specifically improved in terms of a matrix material and magnetic particles to ensure that the polishing pad can simultaneously realize high-efficiency magnetic control polishing and high-efficiency Fenton reaction. The present disclosure also provides compositions of the MRE polishing pad suitable for CMP of a semiconductor wafer, and further provides a preparation method for an MRE polishing pad suitable for CMP of a semiconductor wafer and a specific application method.

In the present application, an organosilicon-polyurethane matrix and CIP@$Fe_3O_4$ composite magnetic particles are simultaneously applied to the MRE polishing pad, and further the MRE polishing pad is applicable for CMP of a semiconductor wafer.

The MRE polishing pad provided in the present application is applicable for CMP of a semiconductor wafer.

The MRE polishing pad suitable for CMP of a semiconductor wafer provided in the present application includes 0.1-5 parts of hollow microspheres, the hollow microsphere having a shell layer composed of a resin material and a particle size of 10-100 μm.

The MRE polishing pad of the present application is provided with pores by the hollow microspheres. Surfaces of the hollow microspheres have terminal hydroxyl groups which can react with isocyanate of polyurethane matrixes to form a stable structure. The hollow microspheres can be uniformly distributed in a chain string of the magnetic particles, and the pores will not be expanded by the influence of temperature to cause microspheres to break. The shell layer of resin is broken by the mechanical force of abrasive materials in the polishing process to form holes which can store polishing liquid and transport the polished abrasive dust, abrasive particles and magnetic particles, thus adjusting a surface removal rate of the material, and the ultra-precision polishing of the surface of the material is realized by preventing the sub-damage of the surface of the material from the polished abrasive dust.

The MRE polishing pad suitable for CMP of a semiconductor wafer of the present application further includes the following components in parts by weight:

5-30 parts of hydroxypropyl silicone oil,
20-50 parts of polyurethane prepolymers,
1-5 parts of chain-extending crosslinking agents,
0.001-0.1 parts of catalyst, and
20-60 parts of CIP@$Fe_3O_4$ composite magnetic particles.

The hydroxypropyl silicone oil is chemically copolymerized with the polyurethane prepolymers to form organosilicon-polyurethane prepolymers, the prepolymers is reacted with the chain-extending crosslinking agents and the catalysts to form a matrix material of a magnetorheological polishing pad, CIP@$Fe_3O_4$ composite magnetic particles form a chain string structure, and the hollow microspheres are clamped and uniformly distributed in the chain string.

In the MRE polishing pad, composite magnetic particles of the hollow microspheres and CIP@$Fe_3O_4$ are uniformly distributed in the organosilicon-polyurethane matrix in a directional manner. In order to have a good magnetic control polishing effect, the MRE polishing pad needs an anisotropic MRE, that is, a chain string structure needs to be formed in the preparation process, so that the chain string structure is preserved after the preparation is completed; and the reapply of a magnetic field in the polishing process will increase the hardness of the MRE polishing pad, thus achieving the mechanical removal in the polishing process controlled by the magnetic field. Therefore, it is advantageous for polishing that the hollow microspheres are clamped in the middle of the formed chain string structure with a uniform structure, that is, the pores of MRE polishing pad are uniformly distributed.

A matrix material formed by reacting the organosilicon-polyurethane prepolymer with other substances defined in the present application can overcome the disadvantages that the organosilicon matrix material has very poor mechanical properties and is difficult to be used in polishing, and overcome the disadvantages that the strength of a polyurethane-based MRE is high, resulting in a small magnetorheological effect. Firstly, because the organosilicon of the present application has a polysiloxane molecular chain, and a Si—O—Si main chain of the molecular chain has a very good flexibility, the organosilicon material exhibits low hardness and material strength, namely, poor mechanical properties. However, because of its good flexibility, as an MRE matrix, the wrapping force to magnetic particles is not large, and the magnetic particles can enhance an elastic modulus of MRE under the action of magnetic field, exhibiting a high magnetorheological effect. Secondly, a polyurethane material is a polymer composite material composed of raw materials: polyol, polyisocyanate and a small molecule chain extender, and a main microstructure is composed of a soft segment of the polyol and a hard segment of the polyisocyanate and small molecule chain extender. The soft segment is relatively flexible, the hard segment has small molecular weight and short chain segments and contains strong polar carbamate. The interaction force between hard segments is large, and there are hydrogen bonds between hard segments and hard segments, which has strong electrostatic force. The hard segment and the soft segment cross-link and penetrate each other, exhibiting great macromechanical property strength and good wear resistance, and the polyurethane material has the title of king of wear resistance. Therefore, polyurethane has good mechanical properties and strong removal capacity when it is used for grinding and polishing. However, a magnetorheological effect of MRE as a matrix of MRE is poor due to the properties of polyurethane. Thirdly, an object is to use MRE as a polishing pad in chemical machinery, which needs to retain both the excellent mechanical properties of polyurethane polishing pad and the high flexibility of silicone, so an organosilicon-polyurethane composite material is provided. The mechanism of the reaction to form the composite material is as follows. Hydroxypropyl silicone oil in silicone has an active group: hydroxyl group (—OH) and the polyurethane prepolymer has an active group: isocyanate group (—NCO). Through organosilicon chemical copolymerization, hydroxyl groups and isocyanate groups can react to form carbamate (—NHCOO—), that is, a main chain of flexible polysiloxane molecule (Si—O—Si) in silicone is connected to a main chain of polyurethane to form a soft segment. Such a composite structure can combine the properties of polyurethane and organosilicon, showing better magnetorheological effect and better mechanical properties.

On the basis of the fact that the organosilicon-polyurethane prepolymer is contained in the matrix material of the present application, the MRE polishing pad has a high magnetorheological effect and excellent comprehensive mechanical properties; the magnetorheological effect of the MRE is to be a magnetic-induced modulus/initial modulus; when a weight fraction of hydroxypropyl silicone oil in the organosilicon-polyurethane matrix is less than 5 parts, the flexibility of the organosilicon-polyurethane matrix is very low, resulting in a larger initial modulus, a smaller magnetic-induced modulus and a poor magnetorheological effect; and the hardness of the MRE polishing pad controlled by an applied magnetic field does not change greatly, and the magnetic control polishing effect on a semiconductor wafer is not obvious. When a weight fraction of hydroxypropyl silicone oil in the organosilicone-polyurethane matrix is more than 30 parts, the flexibility of the organosilicon-polyurethane matrix is very high, resulting in a low initial modulus, a large magnetic-induced modulus, a good magnetorheological effect and a better magnetic control polishing effect at this time. However, the comprehensive mechanical properties and wear resistance of MRE polishing pad are poor, and the polishing pad is easy to wear, resulting in a short service life.

Further, the magnetic particles in the MRE polishing pad of the present application are CIP@$Fe_3O_4$ composite magnetic particles, which can be obtained by any one or more of a wet chemical oxidation method and a hydrothermal method.

CIP particles with high saturation magnetization intensity are coated with a layer of $Fe_3O_4$ with high catalytic activity, and the CIP@$Fe_3O_4$ composite magnetic particles are prepared with fine grains as magnetic particles in the MRE polishing pad. The high magnetic control mechanical properties of MRE polishing pad are realized by utilizing the high saturation magnetization intensity property of CIP. With the help of Fenton reaction between nanoscale $Fe_3O_4$ coated on an outer layer of CIP and $H_2O_2$ in a polishing solution, ·OH with extremely strong oxidizing property is produced. ·OH can react with a semiconductor wafer to generate an oxide layer with low hardness and low bonding force, thus reducing the difficulty of removing polished materials.

Further, in the MRE polishing pad for CMP of a semiconductor wafer of the present application, the hydroxypropyl silicone oil has a molecular weight of 200-10000 g/mol, preferably 1000-3000 g/mol. The molecular weight is related to the reactivity and the length of chain segments; and the greater the molecular weight, the longer the length of chain segments, the better the flexibility and the lower the reactivity. In a preferred molecular weight of 1000-3000 g/mol, a better match of a reaction rate of preparing reaction raw materials can be realized, and the flexibility as a soft segment can be satisfied simultaneously.

Further, the hydroxypropyl silicone oil has a hydroxyl value of 40-80, and the higher the hydroxyl value, the higher the content of hydroxyl groups in the hydroxyl silicone oil, resulting in an increase in the intermolecular force, so that the intertwining and interlacing of hydroxyl silicone oil molecules are more complicated, which increases the friction between molecules and results in the increase of viscosity. Conversely, the lower the hydroxyl value, the less the content of hydroxyl groups in the hydroxyl silicone oil, the weaker the intermolecular force, the less the intermolecular interleaving, and the relatively lower the viscosity. The hydroxypropyl silicone oil reacts better with the polyurethane prepolymer at a hydroxyl value of 40-80.

Further, hydroxypropyl organic groups of the hydroxypropyl silicone oil are located at a side end and/or two ends of a molecular chain, and a main chain of the hydroxyl silicone oil is Si—O—Si, so that the reacted hydroxypropyl group can only be located at the two ends or at the side end.

Further, the polyurethane prepolymer is a prepolymer formed by polyol of polyester/polyether and polyisocyanate. The polyol may be polycaprolactone (PCL), polycarbonate polyol (PCDL), poly(propylene oxide) polyol (PPG), or polytetrahydrofuran polyol (PTMG); and polyisocyanate may be toluene diisocynate (TDI), methylene diphenyl diisocyanate (MDI), or p-phenylene diisocyanate (PPDI). Preferably, the polyurethane prepolymer is PTMG/TDI or PTMG/MDI.

In the present application, the CIP@$Fe_3O_4$ composite magnetic particles are composed of an outer layer of CIP coated with dense nanoscale ferrosoferric oxide, in which the CIP@$Fe_3O_4$ composite magnetic particle has a particle size of 1-10 μm, and $Fe_3O_4$ in a shell layer has a thickness of 10-200 nm and a particle size of 10-60 nm. The generated $Fe_3O_4$ shell layer can be controlled by preparation conditions; at this shell layer thickness, the CIP@$Fe_3O_4$ particles can have very good magnetization intensity, that is, in MRE, the particles can also have a very good magnetorheological effect; and $Fe_3O_4$ generated on the surface has a particle size of 10-60 nm, so that nanoscale $Fe_3O_4$ as a solid phase catalyst has a small specific surface area and can have a better Fenton reaction effect.

The CIP particles in the center of the composite magnetic particles have high saturation magnetization intensity and low coercivity, and the application of the CIP particles in the MRE polishing pad can make the polishing pad have a high magnetorheological effect, CIP being the best magnetic particle for MRE at present. A very thin $Fe_3O_4$ shell layer is generated on the CIP@$Fe_3O_4$ particles prepared in the present application, for example, a $Fe_3O_4$ shell layer with a thickness of 50 nm is generated on the surface of CIP with a particle size of 3 μm, this shell layer only accounts for 3.33% of the CIP@$Fe_3O_4$ particles, namely, having little effect on the CIP magnetization intensity property of an inner core. The nanoscale $Fe_3O_4$ grains coated on the outer layer of the composite magnetic particles do not agglomerate and have a large specific surface area, and the application of grains in the MRE polishing pad enables the polishing pad to have efficient Fenton reaction. The nanoscale $Fe_3O_4$ particles grow uniformly from the surface of the CIP, and therefore, $Fe_3O_4$ is fixed on the surface of the CIP, and the nanoscale $Fe_3O_4$ particles do not attract and agglomerate with each other due to the van der Waals' force (VDW). The CIP@$Fe_3O_4$ particles generate nanoscale $Fe_3O_4$, and as a solid phase catalyst, the $Fe_3O_4$ has a surface in contact with a Fenton reaction solution; the smaller the particle size, the larger the specific surface, which is equivalent to the larger $Fe_3O_4$ surface in contact with the Fenton reaction solution, more hydroxyl radicals can be generated, namely, the greater the Fenton reaction activity.

$Fe_3O_4$ grains on the surface of CIP@$Fe_3O_4$ composite magnetic particles in the MRE polishing pad can react with $H_2O_2$ in the polishing solution for Fenton reaction to generate ·OH with strong oxidizing property. ·OH oxidizes the surface of the semiconductor wafer to generate an oxide layer with lower hardness and lower bonding force because hydroxyl radicals can oxidize the surface of SiC. Subsequently, the mechanical removal action of the abrasive material will remove the oxide layer to expose the fresh surface of the semiconductor wafer to continue oxidation and material removal. In this cycle, the high-efficiency material removal of the semiconductor wafer is realized to obtain an ultra-smooth atomic surface.

A Fenton reaction process of $Fe_3O_4$ grains with $H_2O_2$ is as follows.

$$\equiv Fe^{3+}—OH+H_2O_2 \leftrightarrow \equiv Fe^{2+}\cdot O_2H+H_2O \quad (1)$$

$$\equiv Fe^{2+}\cdot O_2H \rightarrow \equiv Fe^{2+}+HO_2\cdot \quad (2)$$

$$\equiv Fe^{2+}+H_2O_2 \rightarrow \equiv Fe^{3+}—OH+\cdot OH \quad (3)$$

$$Fe_3O_4+8H^+ \rightarrow Fe^{2+}+2Fe^{3+}+4H_2O \quad (4)$$

$$Fe^{2+}H_2O_2+H^+ \rightarrow Fe^{3+}+H_2O+\cdot OH \quad (5)$$

$$Fe^{3+}+H_2O_2 \rightarrow Fe^{2+}+HO_2\cdot+H^+ \quad (6)$$

$$Fe^{3+}+HO_2\cdot \rightarrow Fe^{2+}O_2\uparrow+H^+ \quad (7)$$

The CIP@$Fe_3O_4$ composite magnetic particles in the MRE polishing pad of the present disclosure have a high magnetorheological effect and a high catalytic activity. When a weight fraction of the particles is less than 20 parts, the MRE polishing pad has a small initial modulus and a small magnetic-induced modulus. A modulus of the magnetic particle material is much greater than that of the elastic matrix, and in MRE, the magnetic particle material is mainly composed of the magnetic particles and the elastic matrix. When a weight fraction of the magnetic particles is less than 20 wt %, a weight fraction of the elastic matrix is 80 wt %, and a material modulus (an initial modulus at the time of measurement) of the MRE is small. The magnetic-induced modulus is a modulus of MRE increased under the action of a magnetic field, while magnetic particles are magnetized under the magnetic field. There are interaction forces between the magnetic particles, and this interaction force will enhance the material modulus of MRE, that is, the magnetic field controls the enhancement of the modulus of MRE, simultaneously, less solid phase catalysts participate in Fenton reaction, and the chemical reaction is weaker. When a weight fraction of the particles is more than 60 parts, an initial modulus and a magnetic-induced modulus of the MRE polishing pad are larger, and simultaneously, more solid phase catalysts participate in Fenton reaction, and the chemical reaction is stronger.

Further, the magnetic particles in the polyurethane-elastomer polishing pad are CIP@$Fe_3O_4$ composite magnetic particles, and a particle size of the nanoscale $Fe_3O_4$ grain on the surface of the particle can be controlled by a reaction temperature and a reaction time. In the preparation process, Fe on the CIP surface reacts with water to generate $Fe_3O_4$, and this process is a process in which $Fe_3O_4$ increases from small to large (that is, a particle size increases from small to large). The higher the temperature of water, the faster the generated speed, the larger the particle size, and the longer the time, the larger the particle size.

Further, the surface of the hollow microsphere has hydroxyl groups, and the microsphere may be selected from a commercial product manufactured and sold by MATSUMOTO YUSHI-SEIYAKU Co., Ltd., with a model of FA-30DE.

Further, the function of the catalyst is to accelerate the reaction of polyurethane prepolymer with hydroxypropyl silicone oil and chain-extending crosslinking agents, and the catalyst may be any one of stannous octoate, dibutyltin dilaurate (DBTL) and a tertiary amine catalyst.

Further, the function of the chain-extending crosslinking agent is to further extend a molecular chain of an organosilicon modified polyurethane prepolymer to form a network structure and a hard segment. The chain-extending crosslinking agent may be any one of 1,4-butanediol, ethylene glycol, propylene glycol, 4,4'-diamino-3,3'-dichlorodiphenylmethane (MOCA), trimethyl phosphate (TMP) and formaldehyde.

The present application also provides a preparation method for the MRE polishing pad for CMP of a semiconductor wafer as described above, including the steps of:

S1: performing ultrasonic dispersion on hydroxypropyl silicone oil, polyurethane prepolymers, catalysts, CIP@$Fe_3O_4$ composite magnetic particles and hollow microspheres as defined above at 50-80° C., followed by mechanically stirring for reaction for 5-60 min to obtain an isocyanate-terminated organosilicon-polyurethane prepolymer mixture;

S2: further mixing the organosilicon-polyurethane prepolymer mixture prepared in S1 with chain-extending crosslinking agents by mechanical stirring at 50-80° C. for 1-10 min to obtain a uniform mixture; and S3: performing vacuum defoamation on the uniform mixture prepared in S2, followed by pouring into an MRE polishing pad mold, and applying a parallel magnetic field of 10-800 mT to the mold, followed by vulcanizing and curing at 90-120° C. for 10-16 h to obtain an anisotropic MRE polishing pad.

The present application also provides an application of an MRE polishing pad for CMP of a semiconductor wafer in polishing a semiconductor wafer, including the steps of:

SS1: adding hydrogen peroxide with a mass fraction of 2-20 wt % between a semiconductor wafer and an MRE polishing pad as described above; and SS2: controlling an intensity of a polishing magnetic field to be 0-800 mT and the hardness variations of the MRE polishing pad, to control the mechanical removal of a surface of the semiconductor wafer and realize the removal of a magnetic control polishing material.

Further, in step SS1, the semiconductor wafer is capable of being oxidized by ·OH.

Further, the semiconductor wafer includes any one of a silicon wafer, a silicon carbide wafer, a sapphire wafer, a gallium nitride wafer, and a gallium arsenide wafer.

Compared with the prior art, the present disclosure has the following beneficial effects.

(1) According to the MRE polishing pad provided by the present disclosure, the organosilicon-polyurethane matrix is formed by an organosilicon-modified polyurethane prepolymer. The polishing pad matrix combines the characteristics of flexibility, hydrolysis resistance, acid-alkali corrosion resistance of organosilicon and excellent physical and mechanical properties of polyurethane, and has high flexibility and excellent comprehensive mechanical properties. It has a high magnetorheological effect when polished by the applied magnetic field, which can effectively control the hardness of the polishing pad and realize the controllable polishing of the surface material of the semiconductor wafer. The matrix has good wear resistance and the service life is prolonged.

(2) The MRE polishing pad provided by the present disclosure has the CIP@$Fe_3O_4$ composite magnetic particles with a high saturation magnetization intensity and high catalytic activity. The CIP in the center of the composite magnetic particles has a high saturation magnetization intensity, which can make the MRE polishing pad exhibit a high magnetorheological effect, and realize the high-efficiency and controllable polishing of the semiconductor wafer under the applied magnetic field. In addition, the nanoscale $Fe_3O_4$ on the surface of the particles has the characteristics of large specific surface area and high catalytic activity, which can realize high-efficiency Fenton reaction. The generated ·OH can oxidize the surface of the semiconductor wafer to generate an oxide layer with low hardness and low bonding force, reducing the material removal difficulty of the abrasive material and the polishing pad under the mechanical action, and realizing high-efficiency material removal and obtaining the surface with high quality.

(3) The MRE polishing pad provided by the present disclosure is applied in the polishing process of semiconductor wafers, and has the properties of high-efficiency magnetic control polishing and high-efficiency Fenton reaction. An application of the MRE polishing pad provided by the present disclosure in polishing a semiconductor wafer is to realize simultaneous rough and fine polishing, reduce processing working procedures, improve processing efficiency, and obtain high quality processing surfaces.

DETAILED DESCRIPTION

Figure 1:
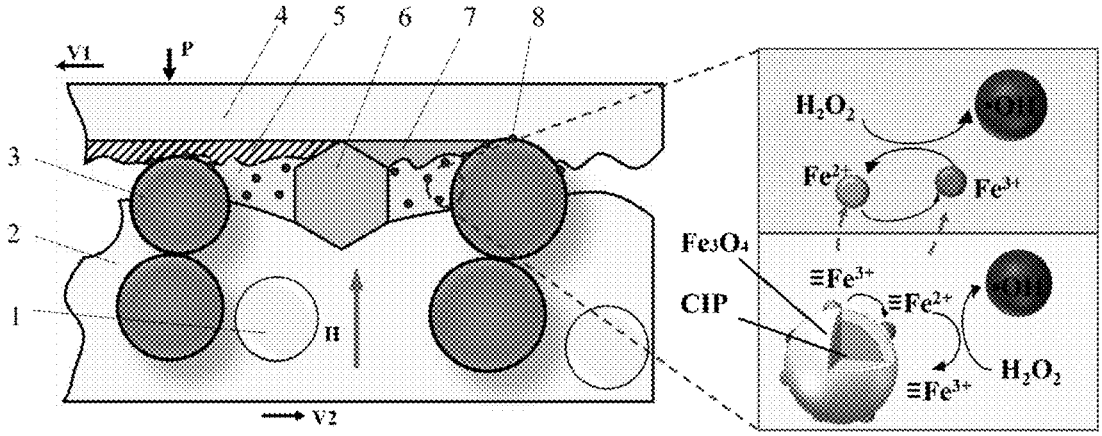
FIG. 1 is a schematic diagram of an MRE polishing pad applied to CMP of a semiconductor wafer, in which: 1-hollow microsphere, 2-organosilicon-polyurethane matrix, 3-CIP@$Fe_3O_4$ composite magnetic particle, 4-semiconductor wafer, 5-polishing solution, 6-abrasive material, 7-oxide layer, and 8-·OH.
Figure 2:
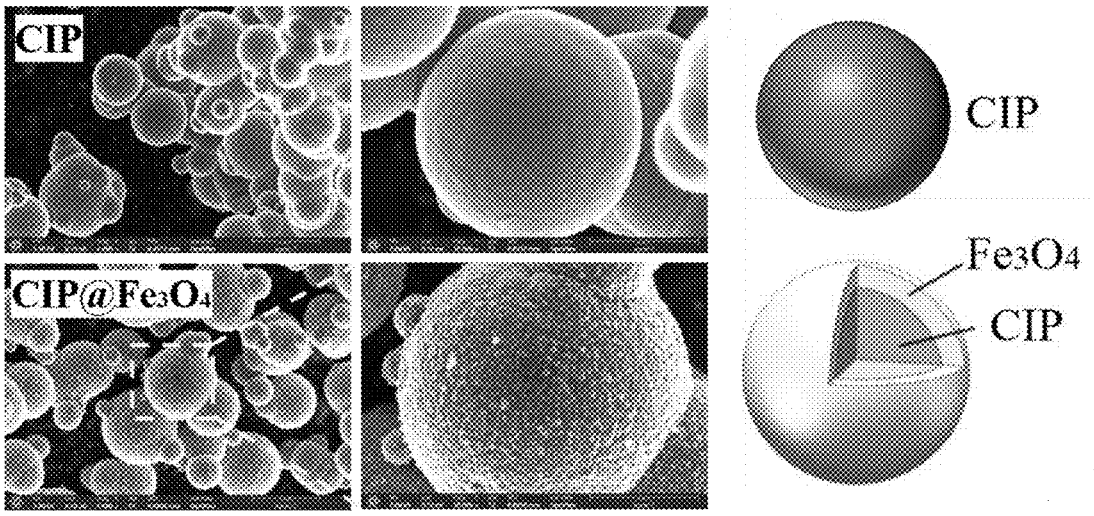
FIG. 2 is a schematic diagram of CIP and CIP@$Fe_3O_4$ composite magnetic particles.
Figure 3:
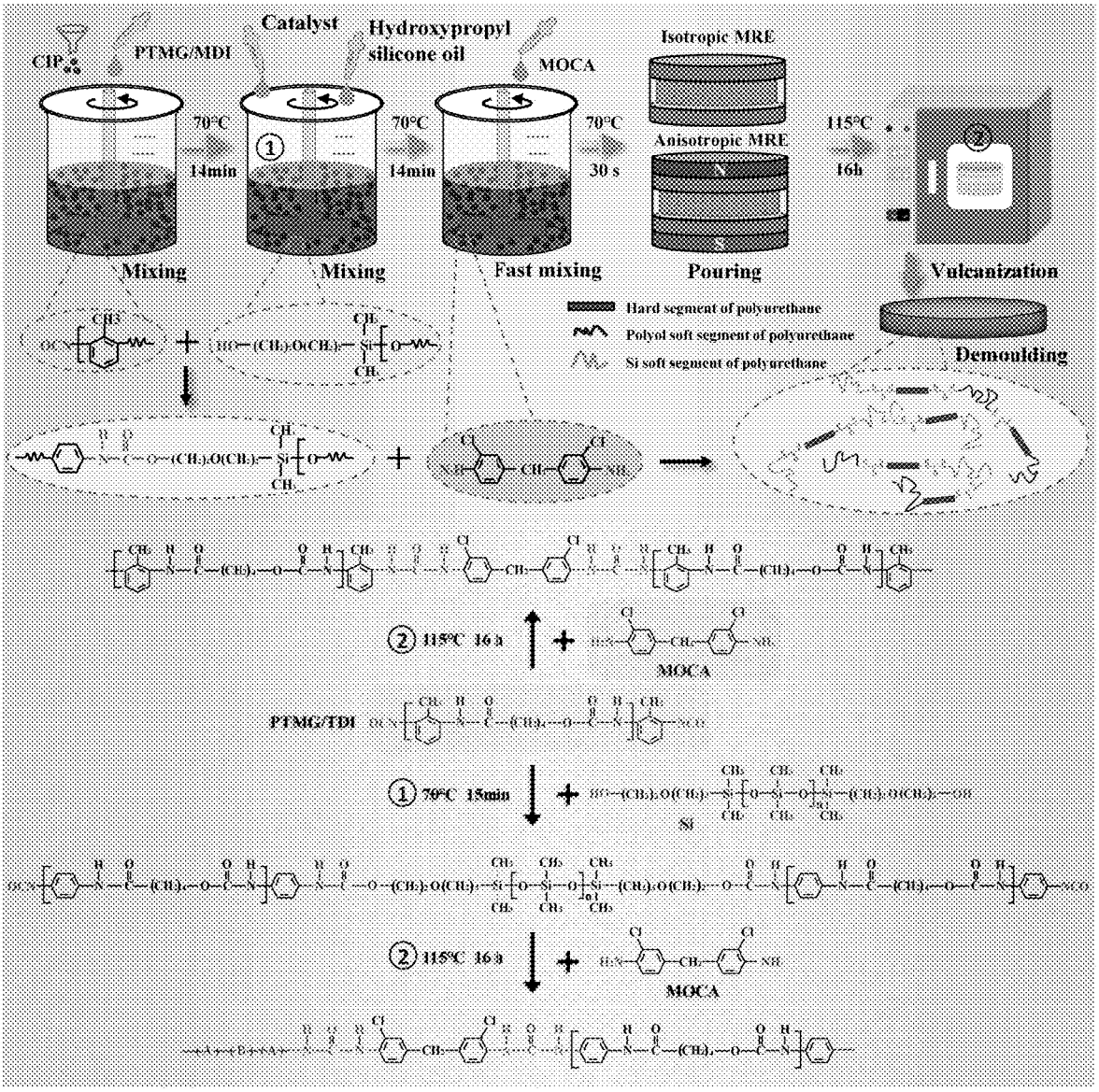
FIG. 3 is a schematic diagram of a preparation reaction process of an organosilicon-polyurethane matrix.

Hereinafter, the present disclosure will be further described with reference to specific embodiments, but examples do not limit the present disclosure in any form. Unless otherwise specified, raw material reagents used in the examples of the present disclosure are conventionally purchased raw material reagents.

Examples 1-5

An MRE polishing pad includes the following components in parts by weight: hydroxypropyl silicone oil, polyurethane prepolymers, magnetic particles, chain-extending crosslinking agents, catalysts, and hollow microspheres, in which, a content of each of the components is as shown in Table 1 below.

| Raw material | Example 1 | Example 2 | Example 3 | Example 4 | Example 5 |
|---|---|---|---|---|---|
| Polyurethane prepolymer | 50 | 38 | 34.8 | 38 | 38 |
| Hydroxypropyl silicone oil | 0 | 12 | 15.2 | 12 | 12 |
| Type of magnetic particle | CIP@$Fe_3O_4$ | CIP@$Fe_3O_4$ | CIP@$Fe_3O_4$ | CIP | $Fe_3O_4$ |
| Mass fraction of magnetic particles | 50 | 50 | 50 | 50 | 50 |
| Chain-extending crosslinking agent | 2.18 | 1.7 | 1.54 | 1.7 | 1.7 |
| Hollow microsphere | 0.1 | 0.1 | 0.1 | 0.1 | 0.1 |
| Catalyst | 0.001 | 0.001 | 0.001 | 0.001 | 0.001 |

A particle size of the magnetic particle is 3 μm, and when the magnetic particle is CIP@$Fe_3O_4$, a thickness of a $Fe_3O_4$ shell layer is 100 nm, and a particle size of $Fe_3O_4$ is 30 nm; the polyurethane prepolymer is PTMG/TDI; the hydroxypropyl silicone oil has a molecular weight of 2000 g/mol and a hydroxyl value of 61; the hollow microsphere is an FA-30DE microsphere with a particle size of 40 μm; the chain-extending crosslinking agent is MOCA; and the catalyst is stannous octoate.

A preparation method for an MRE polishing pad includes the following steps.

In S1: ultrasonic dispersion was performed on hydroxypropyl silicone oil, PTMG/TDI, polyurethane prepolymers, a catalyst stannous octoate, hollow microspheres and magnetic particles at 70° C., followed by mechanical stirring for reaction for 15 min to obtain an isocyanate-terminated organosilicon-polyurethane prepolymer mixture.

In S2: the organosilicon-polyurethane prepolymer mixture was added into a chain-extending crosslinking agent MOCA and stirred at 70° C. at a speed of 2000 r/min for 2 min to obtain a uniform mixture.

In S3: the uniform mixture was poured into a preheated Teflon mold after vacuum defoamation was performed on for 1 min, and a parallel magnetic field of 200 mT was applied to the mold, followed by curing at 110° C. for 16 h to obtain an anisotropic MRE polishing pad.

Magnetorheological Property Test

An Anton Paar MCR301 advanced rotational rheometer was used for test, and a sample was prepared to have a diameter of 20 mm and a thickness of 2 mm for test. An applied magnetic field was provided by a test accessory with MRD180; an intensity of the applied magnetic field could be adjusted by a current, a variation interval of the current being 0-5 A; 20 points were tested, with a test frequency of f=5 Hz; a preset parallel plate pressure was 10 N, a time for each test point was 5 s, and the test was performed under a room temperature environment. A shear modulus, an initial shear modulus and a magnetic-induced shear modulus of MRE were obtained by testing, and a magnetorheological effect was the magnetic-induced shear modulus/initial shear modulus. Magnetorheological property tests were performed on MRE polishing pads of Examples 1-3. Test results are shown in Table 2.

Wear Resistance Test

A cylindrical specimen with a size of (D16 mm and a thickness of 10 mm was prepared by using an AMH-150 DIN abrasion testing machine. Each group of experiments required 3 specimens and 1 No. 1 standard glue, with a counterweight of 7.5 N and abrasion stroke of 84 m. An ultra-precision balance with an accuracy of 0.1 mg was used to weigh before and after the experiment. An abrasion value of relative volume $\Delta V_{rel}$ was calculated according to the following formula, and variations of wear resistance before and after modification were compared.

$$\Delta V_{rel}=(\Delta m_l \times Am_{const})/(\rho_l \times \Delta m_r) \quad (8)$$

where $\Delta m_l$ is a mass loss of experimental glue before and after the experiment, Omconst is a fixed value, the fixed value corresponding to using the No. 1 standard glue being 200 mg, $\rho_l$ is a density of the experimental glue, and Amr is a mass loss of the standard glue.

Test results are shown in Table 2.

Acid-Alkali Corrosion Resistance Test

A dumbbell-shaped elastomer was immersed in the prepared HCl solution with a pH concentration of 3 at 30° C., and after immersion, the sample was removed and dried in a vacuum drying oven at 45° C. for 12 h. The obtained substance was placed at room temperature for one week. An electronic universal testing machine manufactured by Hegewald&Peschke, Germany, was used for a tensile experiment with an effective tensile area of 20 mm, a cross-sectional area of 8 $mm^2$ and a tensile rate of 500 mm/min. The tensile strength was tested. Test results are shown in Table 2.

Table 2 Test Results

TABLE 2

| Test results | | | | | | |
|---|---|---|---|---|---|---|
| Polishing pad | Shore A hardness | Initial modulus (MPa) | Magnetic-induced modulus (MPa) | Magnetorheological effect (%) | Wear amount ($mm^3$) | Retention rate of tensile strength of acid-alkali corrosion (%) |
| Example 1 | 79.7 | 1.90 | 0.32 | 16.8 | 323 | 81.6 |
| Example 2 | 51.5 | 1.03 | 0.81 | 78.6 | 167 | 89.4 |
| Example 3 | 43.2 | 0.72 | 0.89 | 123.6 | 136 | 93.6 |
| Example 4 | 49.3 | 0.98 | 0.97 | 98.9 | 163 | 90.6 |
| Example 5 | 54.2 | 1.12 | 0.36 | 32.1 | 159 | 87.9 |

It can be seen from Table 2 that a polyurethane-based MRE polishing pad in Example 1 has a hardness of 79.7 A, and a small magnetorheological effect because the polyurethane has good mechanical properties, a large hardness and initial modulus, and a small magnetic-induced modulus obtained under a test magnetic field. An organosilicon-polyurethane-based MRE polishing pad in Example 2 has a silicone content of 12 wt %, which combines the high flexibility of organosilicon with a decrease in both hardness and initial modulus, a large magnetic-induced modulus under the conditions of the test magnetic field, and the obtained 78.6% magnetorheological effect. An organosilicon-polyurethane matrix MRE polishing pad in Example 3 has a silicone content of 15.2 wt %; and as the silicone content increases, the flexibility increases and a magnetorheological effect further increases.

It can be seen from Table 2 that the polyurethane-based MRE polishing pad in Example 1 has a wear amount of 323 $mm^3$, while the organosilicon-polyurethane-based MRE polishing pad in Example 2 has a wear amount of 167 $mm^3$, clearly indicating that the organosilicon-polyurethane-based MRE polishing pad has better wear resistance and better service life in polishing.

It can be seen from Table 2 that the polyurethane-based MRE polishing pad in Example 1 has a retention rate of tensile strength of 81.6% after immersion in an acidic solution, while the organosilicon-polyurethane-based MRE polishing pad in Example 2 has a retention rate of tensile strength of 89.4% after immersion in an acidic solution, indicating that the organosilicon-polyurethane-based MRE polishing pad has better acid corrosion resistance, and a glazing degree in polishing can be reduced.

It can be seen from Table 2 that in Example 4, when the magnetic particles are CIP, a hardness of the MRE polishing pad is not significantly different from that of a polishing pad prepared with CIP@$Fe_3O_4$ particles, but because CIP particles have a higher saturation magnetization intensity than the CIP@$Fe_3O_4$ particles, the obtained magnetic-induced modulus is larger and the magnetorheological effect is better. The magnetic particle in the MRE polishing pad in Example 5 is $Fe_3O_4$, a contact area and a movement resistance of the particle with the organosilicon-polyurethane matrix are greater because the $Fe_3O_4$ particle is flaky at this time, resulting in a greater initial modulus and hardness. In addition, the $Fe_3O_4$ magnetic particles have a smaller saturation magnetization intensity than the CIP magnetic particles, and the obtained magnetic-induced modulus is small, eventually resulting in a smaller magnetorheological effect of the MRE polishing pad.

Example 6

An application of an MRE polishing pad in polishing a single crystal SiC wafer includes the following steps.

A polishing solution containing an oxidizing agent $H_2O_2$ was added between a SiC wafer and an MRE polishing pad in Example 2, an intensity of an applied magnetic field was controlled to be 500 mT, and friction polishing was performed between the SiC wafer and the MRE polishing pad.

Specifically, the single crystal SiC for polishing was a C surface of a 2-inch 4H—SiC abrasive sheet, a roughness of an original surface of the abrasive sheet was 2 nm, a workpiece was adsorbed on a workpiece head, the polishing pad was mounted on a polishing disk, and a magnetic field controlling the MRE polishing pad was arranged below the polishing disk. Specific polishing parameters had a concentration of $H_2O_2$ of 10%, a pH of the polishing solution of 3, a polishing abrasive material being a diamond of 0.5 μm, a concentration of an abrasive material of 1 wt %, a polishing pressure of 40 kPa, a rotation speed of the polishing disk of 40 r/min, and a rotation speed of a workpiece disk of 40 r/min.

Example 7

An application of an MRE polishing pad in polishing a single crystal SiC was different from Example 6 in that: a polishing solution containing an oxidizing agent $H_2O_2$ was added to a SiC wafer and an MRE polishing pad prepared in Example 4 for Fenton reaction to oxidize a surface of the SiC wafer (shown in Formula 8), an intensity of an applied magnetic field was controlled to be 500 mT, and friction polishing was performed between the SiC wafer and the MRE polishing pad; and the remaining steps were the same as those in Example 6, so the details were not repeated here.

Example 8

An application of an MRE polishing pad in polishing a single crystal SiC was different from Example 6 in that: a polishing solution containing an oxidizing agent $H_2O_2$ was added between a SiC wafer and an MRE polishing pad prepared in Example 5, an intensity of an applied magnetic field was controlled to be 500 mT, and friction polishing was performed between the SiC wafer and the MRE polishing pad; and the remaining steps were the same as those in Example 6, so the details were not repeated here.

Example 9

An application of an MRE polishing pad in polishing a single crystal SiC was different from Example 6 in that: an intensity of an applied magnetic field was controlled to be 0 mT, and the remaining steps were the same as those in Example 6, so the details were not repeated here.

Example 10

An application of an MRE polishing pad in polishing a single crystal SiC was different from Example 6 in that: an intensity of an applied magnetic field was controlled to be 250 mT, and the remaining steps were the same as those in Example 6, so the details were not repeated here.

Example 11

An application of an MRE polishing pad in polishing a single crystal SiC was different from Example 6 in that: an intensity of an applied magnetic field was controlled to be 750 mT, and the remaining steps were the same as those in Example 6, so the details were not repeated here.

Example 12

An application of an MRE polishing pad in polishing a single crystal SiC was different from Example 6 in that: a concentration of an oxidizing agent $H_2O_2$ was 0%, and the remaining steps were the same as those in Example 6, so the details were not repeated here.

Example 13

An application of an MRE polishing pad in polishing a single crystal SiC was different from Example 6 in that: a concentration of an oxidizing agent $H_2O_2$ was 5%, and the remaining steps were the same as those in Example 6, so the details were not repeated here.

Example 14

An application of an MRE polishing pad in polishing a single crystal SiC was different from Example 6 in that: a concentration of an oxidizing agent $H_2O_2$ was 15%, and the remaining steps were the same as those in Example 6, so the details were not repeated here.

Polishing Effect Test

A polishing test was performed on a SiC wafer by using the MRE polishing pad in Example 6, and a polishing effect was compared with those of Examples 7-14. Mass variations of the wafer before and after polishing were weighed with a precision electronic balance (with an accuracy of 0.1 mg) to calculate a material removal rate. Variations in surface roughness and morphology before and after polishing were measured by using a white-light interferometer (ContourGT-X3). In each test, four different positions on the same radius were measured and taken an average, a variation range of roughness was represented by standard deviation to evaluate the polishing effect. Polishing results are shown in Table 3.

Table 3 Test Results

| Polishing result | Material removal rate (nm/h) | Surface roughness Ra (nm) |
|---|---|---|
| Example 6 | 915.6 | 0.352 |
| Example 7 | 416.5 | 0.924 |
| Example 8 | 628.1 | 0.565 |
| Example 9 | 517.6 | 0.756 |
| Example 10 | 724.7 | 0.478 |
| Example 11 | 1016.8 | 0.432 |
| Example 12 | 636.9 | 0.672 |
| Example 13 | 789.0 | 0.421 |
| Example 14 | 998.6 | 0.324 |

It can be seen from Examples 6, 7 and 8 in Table 3 that an MRE polishing pad prepared with CIP@$Fe_3O_4$ magnetic particles has a better polishing effect of magnetic controlled-heterogeneous Fenton reaction than those prepared with CIP and $Fe_3O_4$ magnetic particles, with a material removal rate of 915.6 nm/h and a minimum surface roughness of Ra 0.352 nm, indicating that the CIP@$Fe_3O_4$ magnetic particles can have a high magnetorheological effect and high-efficiency Fenton reaction simultaneously. In the later stage, the hardness of the MRE polishing pad can be reduced by continuously reducing the intensity of the applied magnetic field, and a surface with better quality can be obtained.

It can be seen by comparing Example 6 with Comparative Examples 9, 10 and 11 that the application of magnetic field polishing can obtain a better polishing effect. The greater the intensity of the magnetic field, the greater the material removal rate, with the best surface roughness at 500 mT. It is indicated that the greater the magnetorheological effect obtained by increasing an intensity of the magnetic field, the greater the hardness and material modulus of the MRE polishing pad, the greater the material mechanical removal force of the abrasive material and polishing pad on the SiC surface in the polishing process, and the greater the material removal rate. However, an excessive magnetic field intensity results in an excessive mechanical removal force, making it difficult to obtain an ultra-smooth surface of the SiC wafer.

It can be seen by comparing Example 6 with Comparative Examples 12, 13 and 14, the added oxidizing agent $H_2O_2$ can react with $Fe_3O_4$ on the surface of the CIP@$Fe_3O_4$ magnetic particles for a heterogeneous Fenton reaction to generate ·OH with a strong oxidizing property, thus oxidizing the surface of the SiC wafer to generate an oxide layer. The higher the concentration of $H_2O_2$ added, the more the oxide layer generated, and the lower the difficulty of material removal; and a higher material removal rate and lower surface roughness can be obtained.

An MRE polishing pad having an organosilicon-polyurethane matrix and CIP@$Fe_3O_4$ magnetic particles of the present disclosure can simultaneously have high magnetorheological polishing and high heterogeneous Fenton reaction polishing, indicating that the polishing pad of the present disclosure can obtain better polishing effect.

Those skilled in the art will realize that the examples and comparative examples herein are to illustrate that the MRE polishing pad has both high magnetic control polishing and high-efficiency heterogeneous Fenton reaction polishing, and to help readers understand the advantages of the present disclosure, so the protection scope of the present disclosure is not limited to such special statements and examples. According to these technical revelations disclosed by the present disclosure, various other process operation parameters can be made for polishing by those skilled in the art without departing from the essence of the present disclosure, and these process operation parameters are still within the protection scope of the present disclosure.

The invention claimed is:

1. A magnetorheological-elastomer (MRE) polishing pad, comprising 0.1-5 parts of hollow microspheres, the hollow microsphere having a shell layer composed of a resin material and a particle size of 10-100 μm; and further comprising the following components in parts by weight:

5-30 parts of hydroxypropyl silicone oil, 20-50 parts of polyurethane prepolymers, 1-5 parts of chain-extending crosslinking agents, 0.001-0.1 parts of catalysts, and 20-60 parts of CIP@$Fe_3O_4$ composite magnetic particles, the hydroxypropyl silicone oil being chemically copolymerized with the polyurethane prepolymers to form organosilicon-polyurethane prepolymers, the organosilicon-polyurethane prepolymers being reacted with the chain-extending crosslinking agents and the catalysts to form a matrix material of a magnetorheological polishing pad, CIP@$Fe_3O_4$ composite magnetic particles forming a chain string structure, and the hollow microspheres being clamped and uniformly distributed in the chain string;

the hydroxypropyl silicone oil having a molecular weight of 200-10000 g/mol and a hydroxyl value of 40-80;

hydroxypropyl organic groups of the hydroxypropyl silicone oil being located at a side end and/or two ends of a molecular chain;

the polyurethane prepolymer being a prepolymer formed by polyol of polyester/polyether and polyisocyanate; and the CIP@$Fe_3O_4$ composite magnetic particles being composed of an outer layer of carbonyl iron powder (CIP) coated with dense nanoscale ferrosoferric oxide, wherein the CIP@$Fe_3O_4$ composite magnetic particle has a particle size of 1-10 μm, and $Fe_3O_4$ in a shell layer has a thickness of 10-200 nm and a particle size of 10-60 nm.

2. A preparation method for an MRE polishing pad according to claim 1, comprising the steps of:

S1: performing ultrasonic dispersion on hydroxypropyl silicone oil, polyurethane prepolymers, catalysts, CIP@$Fe_3O_4$ composite magnetic particles and hollow microspheres at 50-80° C., followed by mechanically stirring for reaction for 5-60 min to obtain an isocyanate-terminated organosilicon-polyurethane prepolymer mixture;

S2: further mixing the organosilicon-polyurethane prepolymer mixture prepared in S1 with chain-extending crosslinking agents by mechanical stirring at 50-80° C. for 1-10 min to obtain a uniform mixture; and S3: performing vacuum defoamation on the uniform mixture prepared in S2, followed by pouring into an MRE polishing pad mold, and applying a parallel magnetic field of 10-800 mT to the mold, followed by vulcanizing and curing at 90-120° C. for 10-16 h to obtain an anisotropic MRE polishing pad.

3. An application of an MRE polishing pad according to claim 1 in polishing a semiconductor wafer, comprising the steps of:

SS1: adding hydrogen peroxide with a mass fraction of 2-20 wt % between a semiconductor wafer and an MRE polishing pad according to claim 1; and SS2: controlling an intensity of a polishing magnetic field to be 0-800 mT and the hardness variations of the MRE polishing pad, to control the mechanical removal of a surface of the semiconductor wafer and realize the removal of a magnetic control polishing material.

4. The application of an MRE polishing pad in polishing a semiconductor wafer according to claim 3, wherein in step SS1, the semiconductor wafer is capable of being oxidized by ·OH.

* * * * *